US005806569A

United States Patent [19]

Gulya et al.

[11] Patent Number: 5,806,569

[45] Date of Patent: Sep. 15, 1998

[54] MULTIPLANAR SINGLE LAYER FORMING FABRIC

[75] Inventors: Thomas Gulya, Raleigh, N.C.; Samuel H. Herring, Appleton; Walter P. Wright, Larsen, both of Wis.

[73] Assignee: Asten, Inc., Charleston, S.C.

[21] Appl. No.: 832,328

[22] Filed: Mar. 26, 1997

Related U.S. Application Data

[63] Continuation of Ser. No. 627,410, Apr. 4, 1996, abandoned.

[51] Int. Cl.[6] ..... D21F 1/00

[52] U.S. Cl. ..... 139/383 A; 442/203; 162/902; 162/903

[58] Field of Search ..... 139/383 A; 442/203, 442/206, 208; 162/116, 117, 902, 903; 428/161, 196

[56] References Cited

U.S. PATENT DOCUMENTS

| | | | |
|---|---|---|---|
| 2,172,430 | 9/1939 | Barrell | 132/383 A |
| 3,301,746 | 1/1967 | Sanford et al. . | |
| 3,573,164 | 3/1971 | Friedberg et al. . | |
| 3,905,863 | 9/1975 | Ayers . | |
| 4,182,381 | 1/1980 | Gisbourne . | |
| 4,191,609 | 3/1980 | Trokhan . | |
| 4,239,065 | 12/1980 | Trokhan . | |
| 4,281,688 | 8/1981 | Kelly et al. . | |
| 4,423,755 | 1/1984 | Thompson . | |
| 4,909,284 | 3/1990 | Kositzke . | |
| 4,989,648 | 2/1991 | Tate et al. . | |
| 4,995,428 | 2/1991 | Tate et al. . | |
| 4,998,569 | 3/1991 | Tate | 139/383 A |
| 5,013,330 | 5/1991 | Durkin et al. . | |
| 5,151,316 | 9/1992 | Durkin et al. . | |
| 5,158,118 | 10/1992 | Tate et al. . | |
| 5,211,815 | 5/1993 | Ramasubramanian et al. . | |
| 5,368,696 | 11/1994 | Cunnane, III et al. . | |
| 5,456,293 | 10/1995 | Ostermayer et al. . | |
| 5,542,455 | 8/1996 | Ostermayer et al. . | |

FOREIGN PATENT DOCUMENTS

| | | |
|---|---|---|
| 0426288 | 5/1991 | European Pat. Off. . |
| 0449192 | 10/1991 | European Pat. Off. . |
| 2192907 | 1/1988 | United Kingdom . |

*Primary Examiner*—Andy Falik
*Attorney, Agent, or Firm*—Volpe and Koenig, PC

[57] ABSTRACT

A papermaking forming fabric having a single layer of machine direction filaments interwoven with smaller and larger diameter cross direction filaments, the larger diameter filaments forming a wear surface on the machine side of the fabric.

17 Claims, 6 Drawing Sheets

MULTIPLANAR SINGLE LAYER FORMING FABRIC

This application is a continuation of application Ser. No. 08/627,410 abandoned, filed on Apr. 4, 1996.

BACKGROUND OF THE INVENTION

1. Field of the Invention

This invention relates generally to papermaking fabrics. More particularly, the present invention relates to forming fabrics which are used to facilitate the initial formation of a paper web during the manufacture of paper. Most particularly, the present invention provides a single layer forming fabric having a high support surface on the sheet side and a wear resistant surface on the machine side.

2. Description of Related Art

In the papermaking process, papermaking machines transform an aqueous slurry of fibers into a continuous paper web which can be processed for a variety of end uses. Papermakers fabrics are employed throughout the papermaking process to transport the web of paper as a continuous sheet through the papermaking equipment. The papermakers fabrics also act as a drive belt for the equipment.

The papermaking process starts in the forming section of a papermaking machine where the aqueous slurry is deposited onto a forming fabric. The forming fabric desirably retains the paper fibers while allowing excess water to pass through. The wet paper web created by this process is then carried by a press fabric through the press section where additional water is removed by squeezing the paper web and fabric between two rolls. The paper web is then carried through the drying section on a dryer fabric to remove additional water through forced evaporation. The design of papermakers fabrics used on each section of a papermaking machine vary in accordance with function.

In the forming section of papermaking machines, the fibers are retained and collected on the upper surface of a forming fabric and formed into a paper sheet. The forming fabric must have a fine mesh weave on the paper contact side in order to avoid marking the paper and to support the fiber from the slurry. The fabric must also have good drainage characteristics for initial water removal to facilitate paper formation. However, as previously noted, the forming fabric also serves as a drive belt and is subjected to high tensile loads in the machine direction and compressive or buckling loads in the cross machine direction.

The performance of a fourdrinier papermaking machine improves when the sheet forms high on the sheet bearing surface of the forming fabric. Where the sheet forms high on the surface of the forming fabric, the sheet releases better, not being trapped within the web, and thus allows for higher machine speeds and higher paper machine efficiency. Additionally when the sheet forms high on the fabric, wire marking on the paper surface is reduced.

Accordingly, it would be desirable to have a forming fabric which allows the sheet to form high on the fabric thereby reducing marking of the paper product. It would be further desirable to also have a forming fabric with improved wear resistant capabilities.

SUMMARY OF THE INVENTION

A papermaking fabric having a sheet side and a machine side is comprised of a system of MD filaments selectively interwoven with a system of CD filaments comprised of alternating smaller and larger diameter filaments that define at least two subsets of filaments, the MD filaments define sheet side floats at least four CD filaments, the larger diameter CD filaments define machine side floats of at least four MD filaments, and the smaller diameter CD filaments define sheet side floats over at least two MD filaments such that the sheet side has a non-planar sheet supporting surface dominated by the MD filaments and the machine side is dominated by the larger CD filament floats.

It is an object of the present invention to provide a papermaking impression fabric, particularly a forming fabric, having both improved sheet support and pocket spaces.

It is a further object of the present invention to provide a papermaking fabric having increased wear resistance on the machine side of the fabric.

DETAILED DESCRIPTION OF THE PREFERRED EMBODIMENT

The invention will be described with reference to drawing figures wherein like numerals represent like elements throughout.

Referring to FIGS. 1–4, a single layer forming fabric is shown with a system of machine direction filaments (MD) 20 interwoven with a system of alternating smaller and larger diameter cross direction filaments(CD) 22, 24. The fabric has a sheet side S and a machine side M.

Figure 1:
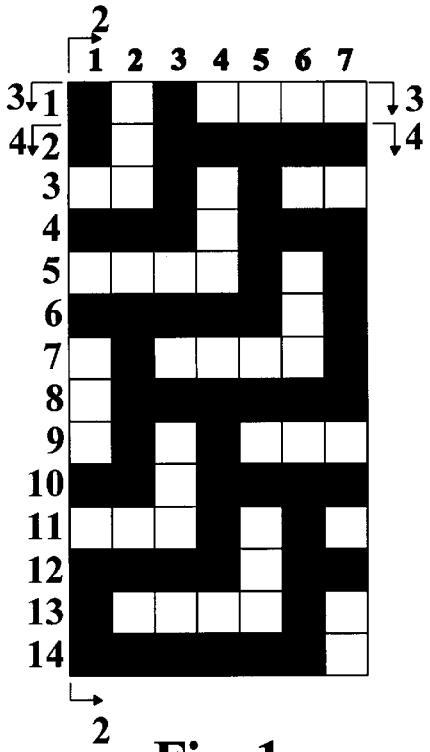
FIG. 1 is a weave pattern diagram for a first embodiment of a fabric according to the present invention.
Figure 2:
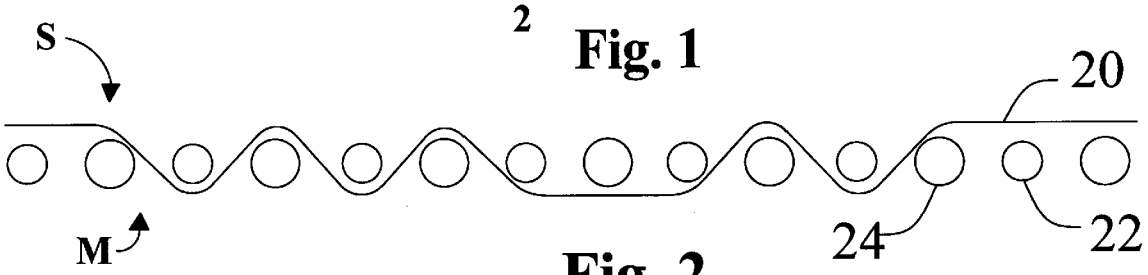
FIG. 2 is a sectional view along line 2—2 of FIG. 1 of a first embodiment of a fabric according to the present invention depicting the weave pattern of a first MD filament interweaving with the CD filaments of the fabric.
Figure 3:
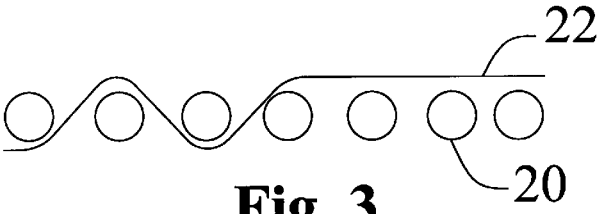
FIG. 3 is a sectional view along line 3—3 of FIG. 1 of a first embodiment of a fabric according to the present invention depicting the weave pattern of a smaller diameter CD filament interweaving with the MD filaments of the fabric.
Figure 4:
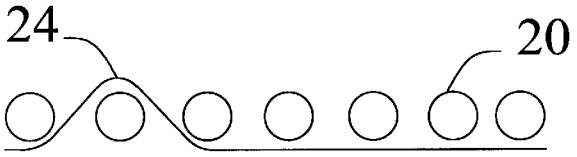
FIG. 4 is a sectional view along line 4—4 of FIG. 1 of a first embodiment of a fabric according to the present invention depicting the weave pattern of a larger diameter CD filament interweaving with the MD filaments of the fabric.
Figure 1A:
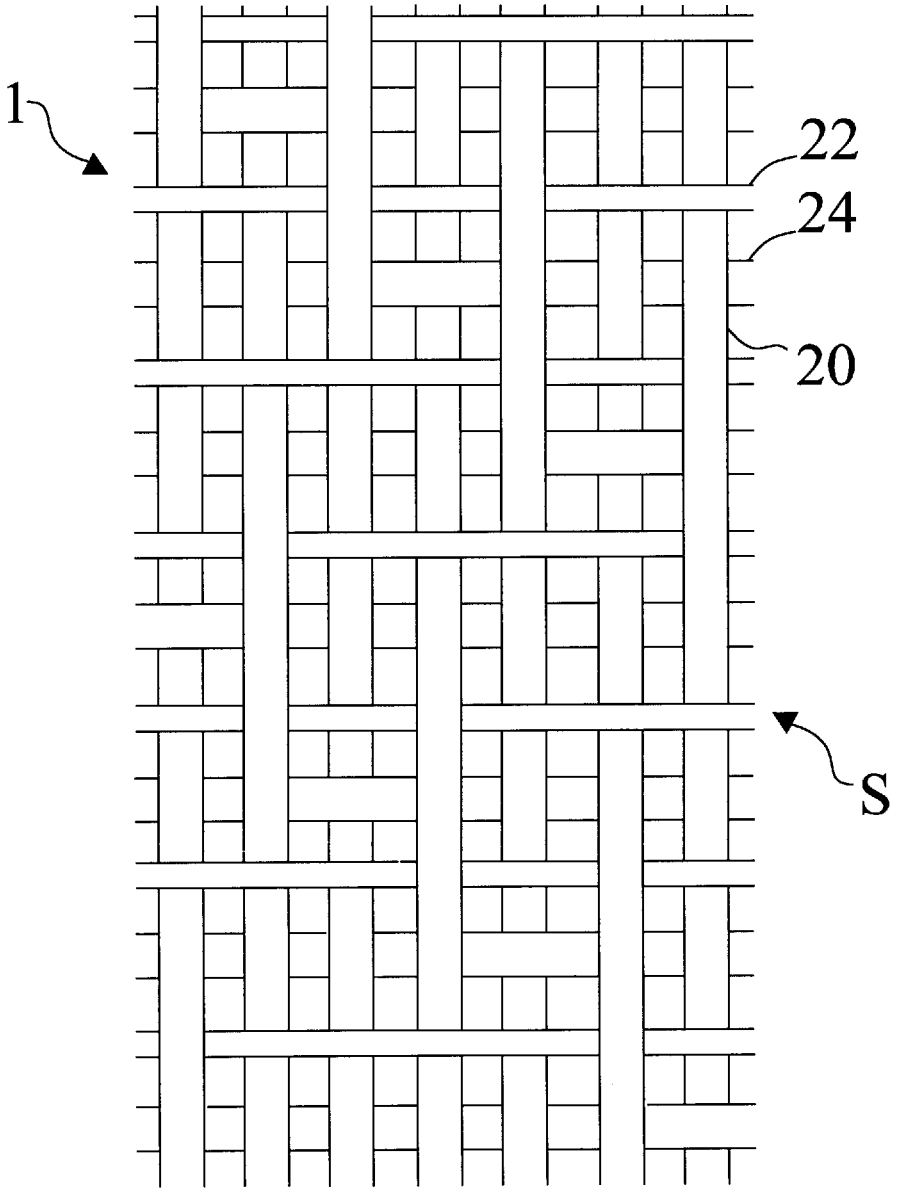
FIG. 1*a* is a top plan view of a papermaking fabric according to the present invention.
Figure 5:
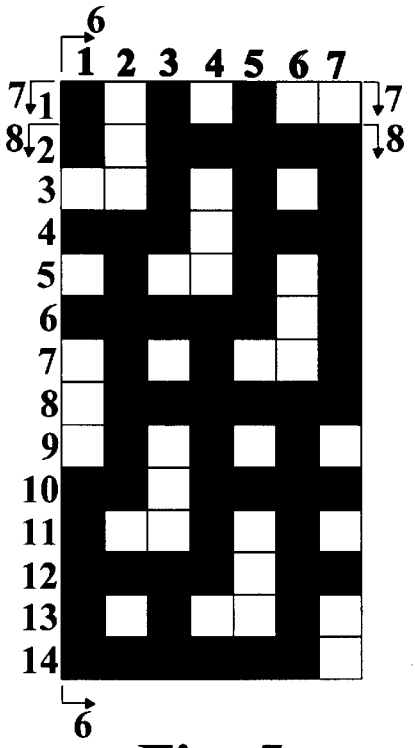
FIG. 5 is a weave pattern diagram for a second embodiment of a fabric according to the present invention.
Figure 6:
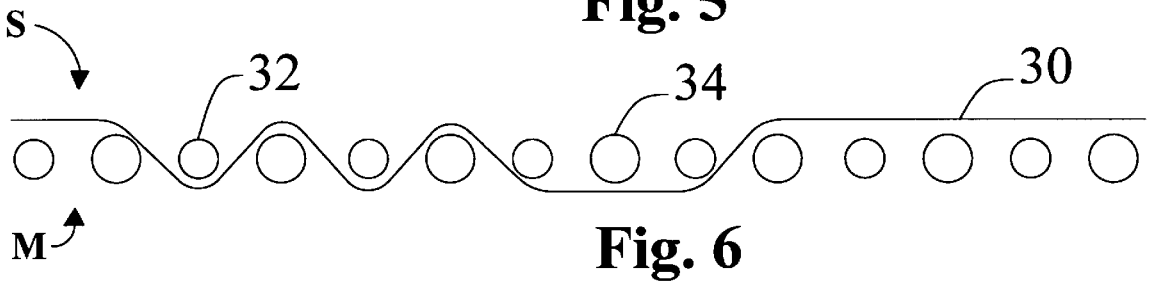
FIG. 6 is a sectional view along line 6—6 of FIG. 5 of a second embodiment of a fabric according to the present invention depicting the weave pattern of a first MD filament interweaving with the CD filaments of the fabric.
Figure 7:
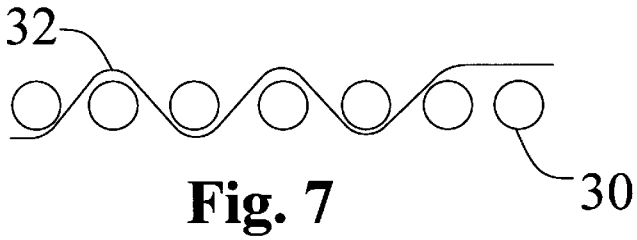
FIG. 7 is a sectional view along line 7—7 of FIG. 5 of a second embodiment of a fabric according to the present invention depicting the weave pattern of a smaller diameter CD filament interweaving with the MD filaments of the fabric.
Figure 8:
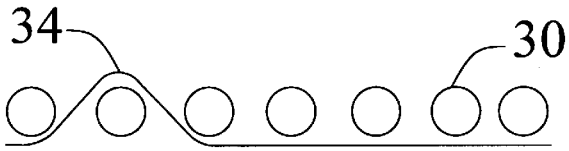
FIG. 8 is a sectional view along line 8—8 of FIG. 5 of a second embodiment of a fabric according to the present invention depicting the weave pattern of a larger diameter CD filament interweaving with the MD filaments of the fabric.
Figure 9:
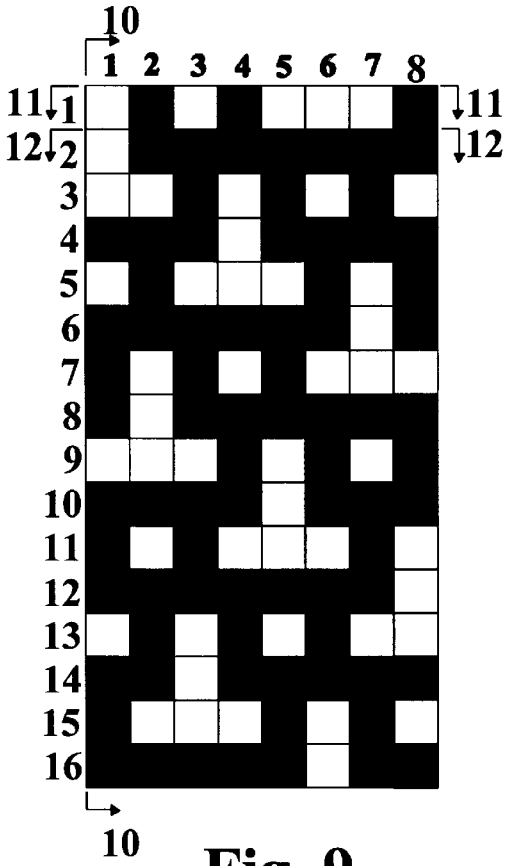
FIG. 9 is a weave pattern diagram for a third embodiment of a fabric according to the present invention.
Figure 10:
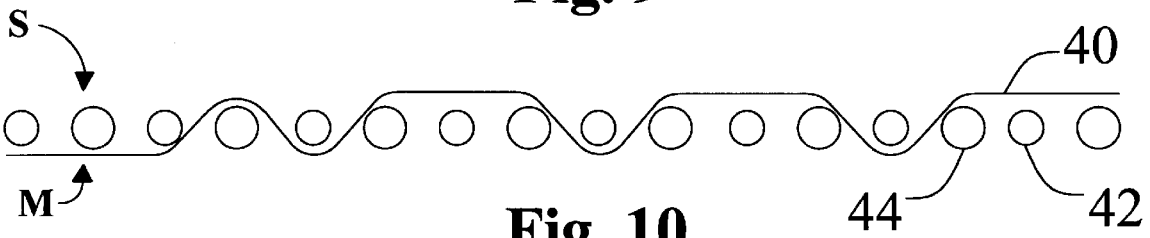
FIG. 10 is a sectional view along line 10—10 of FIG. 9 of a third embodiment of a fabric according to the present invention depicting the weave pattern of a first MD filament interweaving with the CD filaments of the fabric.
Figure 11:
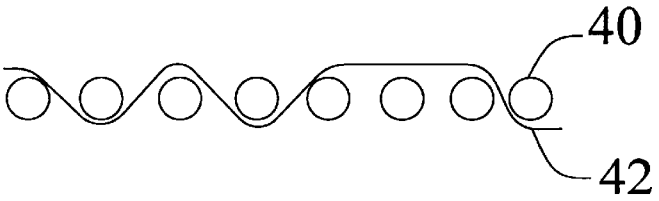
FIG. 11 is a sectional view along line 11—11 of FIG. 9 of a third embodiment of a fabric according to the present invention depicting the weave pattern of a smaller diameter CD filament interweaving with the MD filaments of the fabric.
Figure 12:
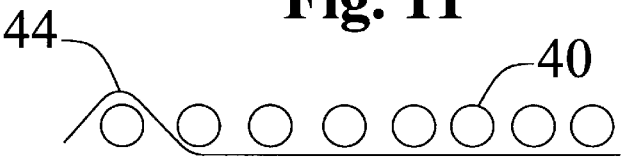
FIG. 12 is a sectional view along line 12—12 of FIG. 9 of a third embodiment of a fabric according to the present invention depicting the weave pattern of a larger diameter CD filament interweaving with the MD filaments of the fabric.

As shown in FIG. 2, MD filament 20 weaves in a repeat pattern of under one, over one, under one, over one, under three, over one, under one and over five with respect to both the smaller and larger diameter CD filaments 22, 24. As shown in FIG. 3, smaller diameter CD filaments 22 weave in a repeat pattern of under one, over one, under one, and over four with respect to the MD filaments 20. As shown in FIG. 4, larger diameter CD filaments 24 weave in a repeat pattern of over one and under six with respect to the MD filaments 20. The larger diameter CD filaments 24 form long machine side floats.

The smaller diameter CD filaments 22 provide floats on the sheet side S of fabric 1. As a result of the weave pattern, smaller CD filaments 22 are urged toward.the sheet side and away from machine side wear. On the other hand, the weave is such that the larger diameter CD filaments 24 are urged toward the machine side and form long-machine side floats that provide a machine side wear surface. The long machine floats of the larger diameter CD filaments 24 have a pronounced bow or arc which is convex to the plane of the MD filaments 20. The bow of the larger diameter CD filaments 24 urge the MD filaments 20 and smaller diameter CD filaments 22 away from the wear plane. In the preferred embodiment, this convex relationship is achieved during crimp interchange in the heat setting process. Heat setting of the woven fabrics is preferably performed at a temperature in the range of 320°to 400° F. and at a linear load range of 0.4 to 1.0 grams per deniers. The heat setting increases the ends per inch count of the MD filaments 20. Since the larger diameter CD filaments 24 have a lesser degree of free shrinkage, heating enhances the bow of the larger diameter CD filaments 24.

Because the MD filaments 20 are in a relatively higher plane than the smaller diameter CD filaments 22 and the long floats of the larger diameter CD filaments 24 dominate the machine side M of the fabric 1, the sheet side S of the fabric is dominated by the MD floats, whereas the smaller diameter CD filaments are not dominant in either the sheet (supporting) side or the machine (running) side surfaces. By alternating the larger diameter CD filaments 24 with the smaller diameter CD filaments 22, the sheet side of the fabric is non-planar. Although the higher profile MD floats and the knuckles of larger diameter CD filaments 24 cause fiber compression in the paper sheet, not shown, when furnish is placed on the non-planar surface of fabric 1, the depressions defining the non-planar portions of the surface will produce areas of uncompressed fibers.

In a second embodiment, shown in FIGS. 5–8, MD filaments 30 weave in a repeat pattern of under one, over one, under one, over one, under three and over seven with respect to both the smaller and larger diameter CD filaments 32, 34. Smaller diameter CD filaments 32 weave in a repeat pattern of under one, over one, under one, over one, under one and over two with respect to the MD filaments 30. Larger diameter CD filaments 34 weave in a repeat pattern of over one and under six with respect to the MD filaments 30. Again, larger diameter CD filaments 34 form long machine side floats.

In a third embodiment, shown in FIGS. 9–12, MD filaments 40 weave in a repeat pattern of under three, over one, under one, over three, under one, over three, under one and over three with respect to smaller and larger diameter CD filaments 42, 44. Smaller diameter CD filaments 42 weave in a repeat pattern of over one, under one, over one, under one, over three and under one with respect to MD filaments 40. Larger diameter CD filaments 44 weave in a repeat pattern of over one and under seven with respect to MD filaments 40. Again, larger diameter CD filaments 44 form long machine side floats.

Figure 13:
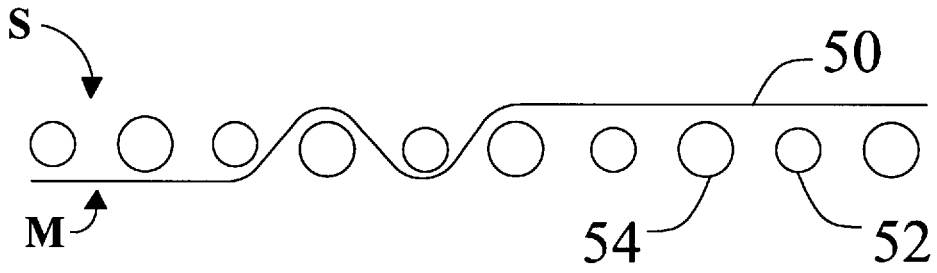
FIG. 13 is a sectional view in the machine direction of a fourth embodiment of a fabric according to the present invention depicting the weave pattern of a first MD filament interweaving with the CD filaments of the fabric.
Figure 14:
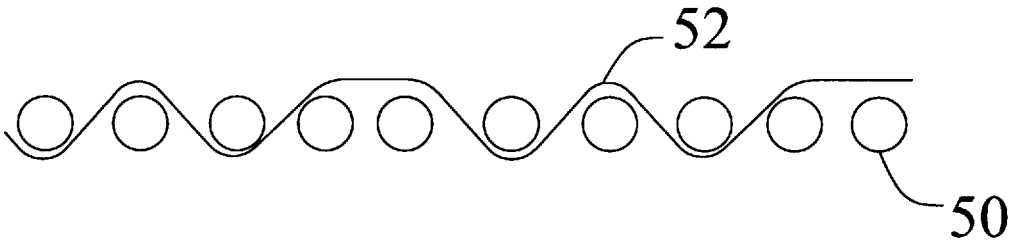
FIG. 14 is a sectional view in the cross direction of a fourth embodiment of a fabric according to the present invention depicting the weave pattern of a smaller diameter CD filament interweaving with the MD filaments of the fabric.
Figure 15:
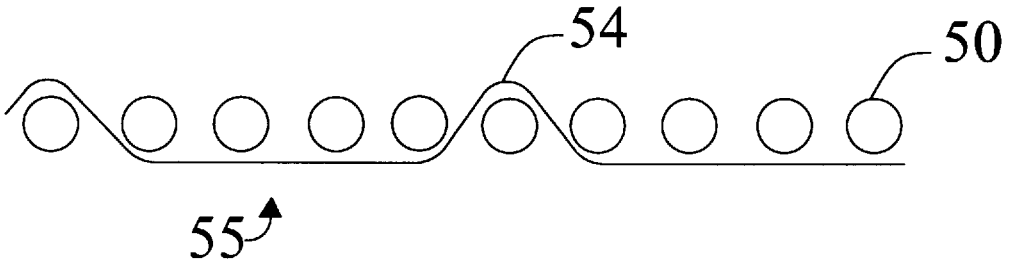
FIG. 15 is a sectional view in the cross direction of a fourth embodiment of a fabric according to the present invention depicting the weave pattern of a larger diameter CD filament interweaving with the MD filaments of the fabric.

In a fourth embodiment, shown in FIGS. 13–15, MD filaments 50 weave in a repeat pattern of under three, over one, under one, and over five with respect to smaller and larger diameter CD filaments 52, 54. Smaller diameter CD filaments 52 weave in a repeat pattern of under one, over one, under one, and over two with respect to MD filaments 50. Larger diameter CD filaments 54 weave in a repeat pattern of over one and under four with respect to MD filaments 50. Again, larger diameter CD filaments 54 form long machine side floats, whereas the smaller diameter CD filaments are not dominant in either the sheet (supporting) side or the machine (running) side surfaces.

The diameter of the larger diameter CD monofilaments is preferably in the range of about 0.1 to 0.8 mm and preferably about 0.4 mm. The diameter of the smaller diameter CD filaments is in a range of about 0.08 and about 0.6 mm, preferably about 0.25 mm.

The MD and CD filaments may be polyester, polyamide, vinyl, acrylic, and other materials as known in the art. It is presently preferred that the filaments be made of polyester which has been treated for hydrolysis resistancy. The filaments may differ in composition from each other.

In a preferred embodiment of the present invention, the woven fabric achieves an air permeability of 450 to 650 CFM, most preferably about 550 CFM as tested on a Fraizer air permeability testing and an open area of 5% to 30%, more preferably 10%. Other embodiments can exhibit an air permeability up to 1000 CFM. The fabric may be woven in a flat or an endless configuration.

Figure 16:
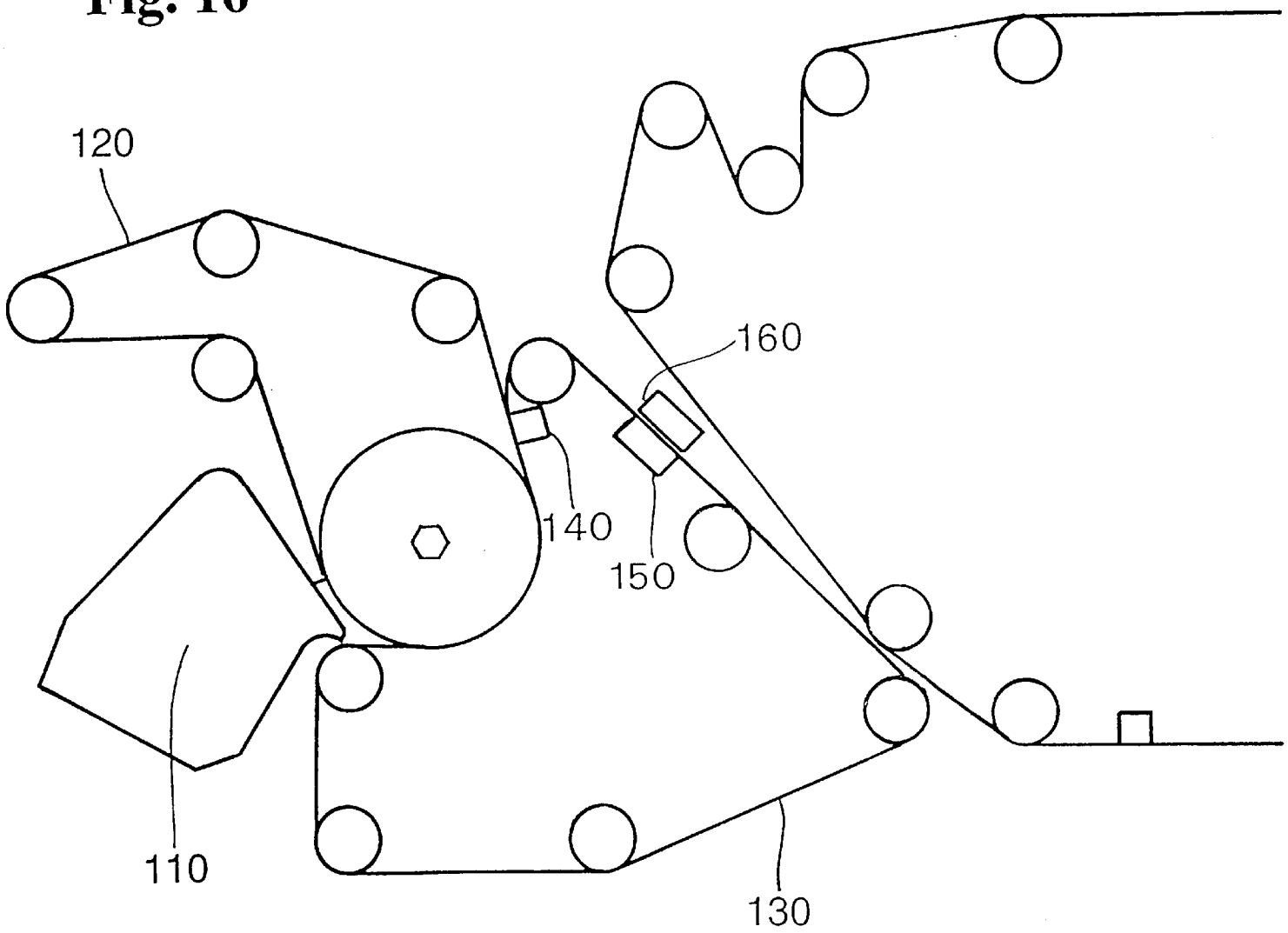
FIG. 16 is an illustration of a process for forming a paper web.

As an example, one conventional forming process is illustrated in FIG. 16. In this process, fibers are fed from a headbox (110) to a converging set of forming fabrics (120, 130). In this twin wire forming arrangement water is removed from the web by centrifugal forces and by vacuum means. The wet nascent web is cleanly transferred to forming fabric (130) via uhle box (140). The web can be optionally processed to remove water by vacuum box (150) and steam shroud (160). The web is then carried along forming fabric (130) for further processing.

We claim:

1. A single-layer papermaking fabric having a sheet side and a machine side is comprised of:

a system of MD filaments selectively interwoven with a system of CD filaments comprised of alternating smaller and larger diameter filaments that define at least two subsets of filaments, the MD filaments are in a pattern that defines sheet side floats of at least four CD filaments, the larger diameter CD filaments are in a pattern that defines machine side floats of at least four MD filaments, and the smaller diameter CD filaments are in a pattern that defines sheet side floats over at least two MD filaments such that the sheet side has a non-planar sheet supporting surface dominated by the MD filaments, the machine side running surface is dominated by the larger CD filament floats and the smaller CD filaments are not dominant in either the supporting or running surface.

2. The fabric of claim 1 wherein the larger diameter CD floats are convex with respect to the MD filaments.

3. The fabric of claim 1 wherein the larger diameter CD monofilaments have a diameter which is in the range of about 0.1 to 0.8 mm.

4. The fabric of claim 1 wherein larger diameter CD monofilaments have a diameter of about 0.4 mm.

5. The fabric of claim 1 wherein the smaller diameter CD filaments have a diameter which is in a range of about 0.08 and about 0.6 mm.

6. The fabric of claim 1 wherein the smaller diameter CD filaments have a diameter of about 0.25 mm.

7. The fabric of claim 1 wherein the fabric achieves an air permeability which is in the range of 450 to 650 CFM.

8. The fabric of claim 1 wherein the fabric achieves an air permeability of about 550 CFM.

9. The fabric of claim 1 wherein the fabric has an open area which is in the range of 5% to 30%.

10. The fabric of claim 1 wherein the fabric has an open area of about 10%.

11. A single-layer papermaker's forming fabric having a sheet side and a machine side is comprised of:

a system of MD filaments selectively interwoven with a system of CD filaments comprised of alternating smaller and larger diameter filaments that define at least two subsets of filaments, the MD filaments are in a pattern that defines sheet side floats of at least four CD filaments, the larger diameter CD filaments are in a pattern that defines machine side floats of at least four MD filaments, and the smaller diameter CD filaments are in a pattern that defines sheet side floats over at least two MD filaments such that the sheet side has a non-planar sheet supporting surface dominated by the MD filaments, the machine side running surface is dominated by the larger CD filament floats and the smaller CD filaments are not dominant in either the supporting or running surface.

12. The fabric of claim 11 wherein the larger diameter CD floats are convex with respect to the MD filaments.

13. The fabric of claim 11 wherein the larger diameter CD monofilaments have a diameter which is in the range of about 0.1 to 0.8 mm.

14. The fabric of claim 11 wherein the smaller diameter CD filaments have a diameter which is in a range of about 0.08 and about 0.6 mm.

15. The fabric of claim 11 wherein the fabric achieves an air permeability which is in the range of 450 to 650 CFM.

16. The fabric of claim 11 wherein the fabric has an open area which is in the range of 5% to 30%.

17. A process of making a paper sheet comprising steps of:

providing papermaking equipment;

providing a multiplanar single-layer papermaker's forming fabric on the papermaking equipment, the papermaker's forming fabric having sheet and machine sides, the fabric further comprised of a system of MD filaments selectively interwoven with a system of CD filaments comprised of alternating smaller and larger diameter filaments that define at least two subsets of filaments, the MD filaments are in a pattern that defines sheet side floats of at least four CD filaments, the larger diameter CD filaments are in a pattern that defines machine side floats of at least four MD filaments, and the smaller diameter CD filaments are in a pattern that defines sheet side floats over at least two MD filaments such that the sheet side has a non-planar sheet supporting surface dominated by the MD filaments, the machine side running surface is dominated by the larger CD filament floats and the smaller CD filaments are not dominant in either the supporting or running surface;

providing a partially dewatered paper web to the sheet side of the fabric; and providing means for impressing the paper web against the fabric.

* * * * *